United States Patent [19]

Matsuura et al.

[11] 4,028,277

[45] June 7, 1977

[54] VOLTAGE-DEPENDENT RESISTOR

[75] Inventors: Mikio Matsuura; Nobuji Nishi, both of Hirakata; Michio Matsuoka, Ibaragi; Takeshi Masuyama, Takatsuki, all of Japan

[73] Assignee: Matsushita Electric Industrial Co., Ltd., Japan

[22] Filed: Jan. 6, 1975

[21] Appl. No.: 538,778

[30] Foreign Application Priority Data

| | | |
|---|---|---|
| Feb. 20, 1974 | Japan | 49-20819 |
| Feb. 20, 1974 | Japan | 49-20820 |
| Feb. 20, 1974 | Japan | 49-20822 |
| Apr. 17, 1974 | Japan | 49-44311 |

[52] U.S. Cl. ..... 252/519; 252/518; 252/520; 252/521

[51] Int. Cl.[2] ..... H01B 1/08

[58] Field of Search ..... 252/518, 519, 520, 521

[56] References Cited

UNITED STATES PATENTS

| | | | |
|---|---|---|---|
| 3,658,725 | 4/1972 | Masuyama et al. | 252/521 X |
| 3,663,458 | 5/1972 | Masuyama et al. | 252/519 X |
| 3,687,871 | 8/1972 | Masuyama et al. | 252/518 |
| 3,764,566 | 10/1973 | Matsuoka et al. | 252/518 |
| 3,936,396 | 2/1976 | Masuyama et al. | 252/518 |

FOREIGN PATENTS OR APPLICATIONS

| | | |
|---|---|---|
| 49-41894 | 4/1974 | Japan |
| 49-41897 | 4/1974 | Japan |
| 49-49197 | 5/1974 | Japan |

*Primary Examiner*—Benjamin R. Padgett
*Assistant Examiner*—E. Suzanne Parr
*Attorney, Agent, or Firm*—Wenderoth, Lind & Ponack

[57] ABSTRACT

A voltage-dependent resistor comprising a sintered body consisting essentially of ZnO, as a main constituent, and, as additives, bismuth oxide ($Bi_2O_3$), titanium oxide ($TiO_2$) and one or two members selected from the group consisting of aluminum fluoride ($AlF_3$), chromium fluoride ($CrF_3$), nickel fluoride ($NiF_2$) and strontium oxide (SrO) with electrodes applied to the opposite surfaces of the sintered body. This voltage-dependent resistor has a low C-value, a high n-value and a high power dissipation for surge energy and high stability to a high D.C. load. Other additives such as cobalt oxide (CoO), manganese oxide (MnO), barium oxide (BaO), boron oxide ($B_2O_3$), chromium oxide ($Cr_2O_3$), nickel oxide (NiO) and germanium oxide ($GeO_2$) improve the voltage nonlinear property of the sintered body.

2 Claims, 1 Drawing Figure

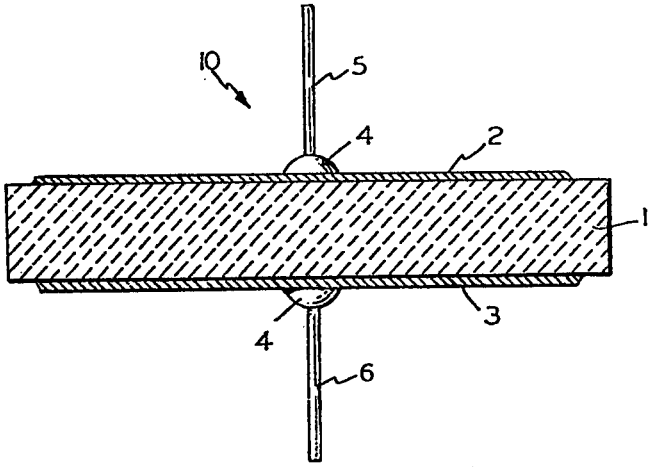
10
5
4
2
1
3
4
6

VOLTAGE-DEPENDENT RESISTOR

This invention relates to a voltage-dependent resistor (varistor) having non-ohmic properties (voltage-dependent property) due to the bulk thereof and more particularly to a voltage-dependent resistor, which is suitable for a surge absorber and a D.C. stabilizer.

Various voltage-dependent resistors such as silicon carbide voltage-dependent resistors, selenium rectifiers and germanium or silicon p-n junction diodes have been widely used for stabilization of voltage of electrical circuits or suppression of abnormally high surge induced in electrical circuits. The electrical characteristics of such voltage-dependent resistors are expressed by the relation:

$$I = \left(\frac{V}{C}\right)^n \quad (1)$$

where V is the voltage across the resistor, I is the current flowing through the resistor, C is a constant corresponding to the voltage at a given current and exponent $n$ is a numerical value greater than 1. The value of $n$ is calculated by the following equation:

$$n = \frac{\log_{10}(I_2/I_1)}{\log_{10}(V_2/V_1)} \quad (2)$$

where $V_1$ and $V_2$ are the voltage at given currents $I_1$ and $I_2$, respectively. The desired value of C depends upon the kind of application to which the resistor is to be put. It is ordinarily desirable that the value of $n$ be as large as possible since this exponent determines the extent to which the resistors depart from ohmic characteristics. Conveniently, $n$-value defined by $I_1$, $I_2$, $V_1$ and $V_2$ as shown in equation (2) is expressed by ${}_1n_2$ for distinguishing from the $n$-value calculated by other currents or voltages.

Voltage-dependent resistors comprising sintered bodies of zinc oxide with or without additives and non-ohmic electrodes applied thereto, have already been disclosed as seen in U.S. Pat. Nos. 3,496,512, 3,570,002, 3,503,029, 3,689,863 and 3,766,098. The nonlinearity (voltage-dependent property) of such voltage-dependent resistors is attributed to the interface between the sintered body of zinc oxide with or without additives and a silver paint electrode, and is controlled mainly by changing the compositions of the sintered body and the silver paint electrode. Therefore, it is not easy to control the C-value over a wide range after the sintered body is prepared. Similarly, in voltage-dependent resistors comprising germanium or silicon p-n junction diodes, it is difficult to control the C-value over a wide range because the nonlinearity of these voltage-dependent resistors is not attributed to the bulk but rather to the p-n junction. In addition, it is almost impossible for those zinc oxide voltage-dependent resistors mentioned above and germanium or silicon diode voltage-dependent resistors to obtain the combination of a C-value higher than 100 volts, an $n$-value higher than 10 and high surge resistance to surges of more than 100A.

On the other hand, the silicon carbide voltage-dependent resistors have nonlinearity due to the contacts among the individual grains of silicon carbide bonded together by a ceramic binding material, i.e. to the bulk, and the C-value is controlled by changing a dimension in the direction in which the current flows through the voltage-dependent resistors. In addition, the silicon carbide voltage-dependent resistors have high surge resistance thus rendering them suitable e.g. as surge absorbers. The silicon carbide varistors, however, have a relatively low $n$-value ranging from 3 to 7 which results in poor surge suppression as well as poor D.C. stabilization. Another defect of the silicon carbide voltage-dependent resistors as a D.C. stabilizer is large change rate in the C-value and the $n$-value during the D.C. load life test.

There have been known, on the other hand, voltage-dependent resistors of bulk type comprising a sintered body of zinc oxide with additives, as seen in U.S. Pat. Nos. 3,663,458, 3,632,529, 3,634,337, 3,598,763, 3,682,841, 3,642,664, 3,658,725, 3,687,871, 3,723,175, 3,778,743, 3,806,765, 3,811,103 and copending U.S. patent application Ser. Nos. 29,416, 388,169, 428,737 and 489,827, now U.S. Pat. Nos. 3,936,396, 3,863,193, 3,872,582 and 3,953,373, respectively. These zinc oxide voltage-dependent resistors of bulk type contain, as additives, one or more combinations of oxides or fluorides of bismuth, cobalt, manganese, barium, boron, berylium, mangnesium, calcium, strontium, titanium, antimony, germanium, chromium and nickel. The C-value thereof may be controlled, primarily by changing the compositions of said sintered body and the distance between electrodes. They have an excellent voltage-dependent property for the $n$-value in a region of current below 10A/cm$^2$. For a current higher than 10A/cm$^2$, however, the $n$-value falls to below 10. This defect of these zinc oxide voltage-dependent resistors of bulk type is presumably due mainly to their low $n$-value for the lower C-value, especially less than 80 volts. In general, these zinc oxide voltage-dependent resistors of the bulk type, mentioned above, have very low $n$-value, i.e. less than 20, when the C-value is lower than 80 volts. The power dissipation for surge energy, however, has a relatively low value as compared with that of the conventional silicon carbide voltage-dependent resistor, so that the change rate of C-value exceeds e.g. 20 percent after two standard surges of 8×20 $\mu$sec wave form in a peak current of 500A/cm$^2$, applied to the zinc oxide voltage-dependent resistors of the bulk type. Another defect of these zinc oxide voltage-dependent resistors of the bulk type is a poor stability to D.C. load, particularly their remarkable decrease of C-value measured even in a current region such as 10mA, after applying a high D.C. power to the voltage-dependent resistors especially when they have a C-value of less than 80 volts. This deterioration in the C-value, especially less than 80 volts, is unfavorable e.g. for a voltage stabilizer which requires high accuracy and low loss for low voltage circuits. These defects of these zinc oxide voltage-dependent resistors of bulk type are presumably due mainly to their low $n$-value for the lower C-value, especially of less than 80 volts. The development of the voltage-dependent resistors having a C-value e.g. less than 80 volts have been strongly desired for the application of the low voltage circuits, such as in the automobile industry and home appliances, but the $n$-value of a conventional voltage-dependent resistors having lower C-values is too small to satisfy uses such as voltage stabilizers and surge absorbers. For these reasons, voltage-dependent resistors of this type, having a C-value less than 80 volts, have hardly been used in low voltage application.

An object of this invention is to provide a voltage-dependent resistor having a low C-value less than 80 volts, a high $n$-value even in a region of current between $10A/cm^2$ and $100A/cm^2$, a high power dissipation for surge energy and high stability for a high D.C. load.

This and other objects of this invention will become apparent upon consideration of the following detailed description taken together with the accompanying drawing in which the single FIGURE is cross-sectional view of a voltage dependent resistor in accordance with this invention.

Before proceeding with a detailed description of the manufacturing process of the voltage-dependent resistor contemplated by this invention, its construction will be described with reference to the single FIGURE wherein reference numeral 10 designates, as a whole, a voltage-dependent resistor comprising, as its active element, a sintered body having a pair of electrodes 2 and 3 in ohmic contact applied to opposite surfaces thereof. The sintered body 1 is prepared in a manner hereinafter set forth and is any form such as circular, square or rectangular plate form. Wire leads 5 and 6 are attached conductively to the electrodes 2 and 3, respectively, by a connection means 4 such as solder or the like.

It has been discovered according to the invention that a voltage-dependent resistor comprising a sintered body of a composition which comprises, as additives, 0.1 to 5.0 mole percent of bismuth oxide ($Bi_2O_3$), 0.1 to 3.0 mole percent of titanium oxide ($TiO_2$) and one or two members selected from the group consisting of 0.01 to 5.0 mole percent of aluminum fluoride ($AlF_3$), 0.01 to 5.0 mole percent of chromium fluoride ($CrF_3$), 0.01 to 5.0 mole percent of nickel fluoride ($NiF_2$) and 0.01 to 5.0 mole percent of strontium oxide (SrO), and the remainder being zinc oxide (ZnO), as a main constituent, and electrodes applied to opposite surfaces of the sintered body, has a non-ohmic property (voltage-dependent property) due to the bulk itself. Therefore, its C-value can be changed without impairing its $n$-value by changing the distance betweeen the electrodes at opposite surfaces. According to this invention, the voltage-dependent resistor has a low C-value and a high $n$-value even at a current region of between $10A/cm^2$ and $100A/cm^2$.

According to this invention, high stability with respect to a surge impulses and a high D.C. load, and the higher $n$-value with a low C-value, e.g. less than 80 volts, can be obtained when the zinc oxide (ZnO) sintered body comprises, as additives 0.1 to 5.0 mole percent of bismuth oxide ($Bi_2O_3$), 0.1 to 3.0 mole percent of titanium oxide ($TiO_2$), one or two members selected from the group consisting of 0.01 to 5.0 mole percent of aluminum fluoride ($AlF_3$), 0.01 to 5.0 mole percent of nickel fluoride ($NiF_2$), 0.01 to 5.0 mole percent of chromium fluoride ($CrF_3$) and 0.01 to 5.0 mole percent of strontium oxide (SrO) and at least one member selected from the group consisting of 0.1 to 3.0 mole percent of cobalt oxide (CoO) and 0.1 to 3.0 mole percent of manganese oxide (MnO).

According to this invention, stability with respect to a high D.C. load and a surge power can be remarkably improved when the zinc oxide (ZnO) sintered body comprises, as additives, 0.1 to 5.0 mole percent of bismuth oxide ($Bi_2O_3$), 0.1 to 3.0 mole percent of cobalt oxide (CoO), 0.1 to 3.0 mole percent of manganese oxide (MnO), 0.1 to 3.0 mole percent of titanium oxide ($TiO_2$), 0.01 to 5.0 mole percent of nickel fluoride ($NiF_2$) and one member selected from the group consisting of 0.01 to 5.0 mole percent of chromium oxide ($Cr_2O_3$), 0.01 to 5.0 mole percent of nickel oxide (NiO), 0.01 to 5.0 mole percent of barium oxide (BaO), 0.01 to 5.0 mole percent of boron oxide ($B_2O_3$) and 0.01 to 5.0 mole percent of germanium oxide ($GeO_2$).

The sintered body 1 can be prepared by per se well known ceramic techniques. The starting materials in the compositions in the foregoing description are mixed in a wet mill so as to produce homogeneous mixtures. The mixtures are dried and pressed in a mold into desired shapes at a pressure from 50 $kg./cm^2$ to 500 $kg./cm^2$. The pressed bodies are sintered in air at 1000° C to 1450° C for 1 to 20 hours, and then furnace-cooled to room temperature (about 15° C to about 30° C). The mixture can be preliminarily calcined at 600° to 1000° C and pulverized for easy fabrication in a subsequent pressing step. The mixture to be pressed can be admixed with a suitable binder such as water, polyvinyl alcohol, etc. It is advantageous that the sintered body be lapped at the opposite surfaces by abrasive powder such as silicon carbide in a particle size of about 10 to 50$\mu$ in mean diameter. The sintered bodies are provided, at the opposite surfaces thereof, with electrodes in any available and suitable method such as silver painting, vacuum evaporation or flame spraying of metal such as Al, Zn, Sn, etc.

The voltage-dependent properties are not practically affected by the kind of electrodes used, but are affected by the thickness of the sintered bodies. Particularly, the C-value varies in proportion to the thickness of the sintered bodies, while the $n$-value is almost independent of the thickness. This surely means that the voltage-dependent property is due to the bulk itself, but not to the electrodes.

Lead wires can be attached to the electrodes in a per se conventional manner by using conventional solder. It is convenient to employ a conductive adhesive comprising silver powder and resin in an organic solvent in order to connect the lead wires to the electrodes. Voltage-dependent resistors according to this invention have a high stability for the surge test which is carried out by applying a surge wave form of 8×20 $\mu$sec and more than $500A/cm^2$. The $n$-value does not change remarkably after the heating cycles, the load life test, humidity test and surge life test. It is advantageous for achievement of high stability with respect to humidity that the resultant voltage-dependent resistors be embedded in a humidity proof resin such as epoxy resin and phenol resin in a per se well known manner.

The following examples are meant to illustrate preferred embodiment of this invention, but are not meant to limit the scope thereof.

EXAMPLE 1

Zinc oxide and additives as shown in Table 1 was mixed in a wet mill for 24 hours. The mixture was dried and pressed in a mold discs of 13.5 mm in diameter and 7 mm in thickness at a pressure of 250 $kg/cm^2$.

The pressed bodies were sintered in air under the conditions shown in Table 1, and then furnace-cooled to room temperature. The sintered body was lapped at the opposite surfaces thereof into the thickness shown in Table 1 by silicon carbide abrasive in particle size of 30μ in mean diameter. The opposite surfaces of the sintered body were provided with a spray metallized film of aluminum in a per se well known technique.

The electrical characteristics of the resultant sintered bodies are shown in Table 1, which shows that the C-value varies approximately in proportion to the thickness of the sintered body while the values of $n_1$ and $n_2$ are the $n$-value defined between 0.1mA and 1mA and between 10A and 100A, respectively, and the $n$-values are essentially independent of the thickness. It will be readily recognized that the voltage-dependent property of the sintered body is attributed to the sintered body itself.

EXAMPLE 2

Zinc oxide and additives as shown in Table 2 were fabricated into voltage-dependent resistors by the same method as that of Example 1, except that the sintering condition in this Example 2 was at 1350° C for 1 hour. The electrical characteristics of the resultant resistors are shown in Table 2. The thickness is 1 mm. The change rate of C- and $n$-values after an inpulse test and a D.C. load life test are shown in Table 2. The impulse test was carried out by applying $10^5$ impulses of 8×20μsec, 500A, and the D.C. load life test was carried out by applying a D.C. load of 2 watts at 70° C ambient temperature for 1000 hours. It can be easily understood that the further addition of cobalt oxide and/or manganese oxide shows a higher $n$-value, a low C-value and small change rates of both C- and $n$-values after impulse and D.C. load life tests.

EXAMPLE 3

Zinc oxide and additives of Table 3 were fabricated into voltage-dependent resistors by the same process as that of Example 1, except that the sintering condition was 1350° C for 1 hour. The electrical characteristics of resulting resistors are shown in Table 3. The change rates of C- and $n$-value after impulse test and after D.C. load life test carried out by the same methods as those of Example 2, except that impulse repeated times in this Example 3 were $10^6$ times are shown in Table 3. It will be easily understood that the combined addition of bismuth oxide, cobalt oxide, manganese oxide, titanium oxide, nickel fluoride and one member selected from the group consisting of chromium oxide, nickel oxide, barium oxide, boron oxide and germanium oxide, results in a high $n$-value, a smaller change rate of C-value, the smaller change rate of $n$-value and a low C-value as compared with the above mentioned U.S. Patents and Example 2. A positive change rate of the $n$-value means that the voltage-dependent property is improved after the test and its reliability is increased for low voltage application.

EXAMPLE 4

The resistors of Examples 1, 2 and 3 were tested in accordance with a method widely used for electronic component parts. A heating cycle test was carried out by repeating 5 times the cycle in which the resistors are kept at 85° C ambient temperature for 30 minutes, cooled rapidly to −20° C and then kept at such temperature for 30 minutes. A humidity test was carried out at 40° C and 95% relative humidity for 1000 hours. Table 4 shows the average change rates of C-value and $n$-value of the resistors after the heating cycle test and the humidity test. It is easily understood that each sample has a small change rate.

Table 1

| Additives (mole %) | | | | | | Sintering condition | | | Characteristics of Resultant Resistor | | |
|---|---|---|---|---|---|---|---|---|---|---|---|
| $Bi_2O_3$ | $TiO_2$ | $AlF_3$ | $CrF_3$ | $NiF_2$ | SrO | Temp. (° C) | Time (hrs) | Thickness (mm) | C (V) at 10mA | $n_1$ | $n_2$ |
| 0.1 | 0.1 | 0.01 | — | — | — | 1000 | 5 | 1 | 15 | 6 | 10 |
| 0.1 | 0.1 | 5.0 | — | — | — | 1350 | 1 | 1 | 44 | 8 | 12 |
| 0.1 | 3.0 | 0.01 | — | — | — | 1300 | 2 | 1 | 33 | 7 | 11 |
| 0.1 | 3.0 | 5.0 | — | — | — | 1350 | 1 | 1 | 50 | 9 | 13 |
| 5.0 | 0.1 | 0.01 | — | — | — | 1200 | 5 | 1 | 43 | 8 | 12 |
| 5.0 | 0.1 | 5.0 | — | — | — | 1450 | 1 | 1 | 52 | 9 | 13 |
| 5.0 | 3.0 | 0.01 | — | — | — | 1350 | 2 | 1 | 34 | 8 | 12 |
| 5.0 | 3.0 | 5.0 | — | — | — | 1350 | 5 | 1 | 60 | 8 | 12 |
| 0.5 | 0.5 | 0.5 | — | — | — | 1350 | 1 | initial (5) | 127 | 7 | 11 |
| 0.5 | 0.5 | 0.5 | — | — | — | 1350 | 1 | 3 | 75 | 7 | 11 |
| 0.5 | 0.5 | 0.5 | — | — | — | 1350 | 1 | 1 | 25 | 7 | 11 |
| 0.1 | 0.1 | — | 0.01 | — | — | 1000 | 20 | 1 | 13 | 6 | 10 |
| 0.1 | 0.1 | — | 5.0 | — | — | 1300 | 2 | 1 | 28 | 7 | 11 |
| 0.1 | 3.0 | — | 0.01 | — | — | 1350 | 2 | 1 | 30 | 7 | 11 |
| 0.1 | 3.0 | — | 5.0 | — | — | 1450 | 1 | 1 | 42 | 8 | 11 |
| 5.0 | 0.1 | — | 0.01 | — | — | 1350 | 1 | 1 | 31 | 7 | 10 |
| 5.0 | 0.1 | — | 5.0 | — | — | 1450 | 1 | 1 | 45 | 8 | 11 |
| 5.0 | 3.0 | — | 0.01 | — | — | 1300 | 10 | 1 | 50 | 8 | 11 |
| 5.0 | 3.0 | — | 5.0 | — | — | 1350 | 1 | 1 | 72 | 8 | 12 |
| 0.5 | 0.5 | — | 0.5 | — | — | 1350 | 1 | initial (5) | 104 | 7 | 11 |
| 0.5 | 0.5 | — | 0.5 | — | — | 1350 | 1 | 3 | 62 | 7 | 15 |
| 0.5 | 0.5 | — | 0.5 | — | — | 1350 | 1 | 1 | 21 | 7 | 11 |
| 0.1 | 0.1 | — | — | 0.01 | — | 1200 | 5 | initial (5) | 54 | 8 | 14 |
| 0.1 | 0.1 | — | — | 0.01 | — | 1200 | 5 | 3 | 33 | 7 | 13 |
| 0.1 | 0.1 | — | — | 0.01 | — | 1200 | 5 | 1 | 11 | 7 | 13 |
| 0.1 | 0.1 | — | — | 5.0 | — | 1300 | 1 | 1 | 28 | 7 | 13 |
| 0.1 | 3.0 | — | — | 0.01 | — | 1250 | 10 | 1 | 30 | 7 | 14 |
| 0.1 | 3.0 | — | — | 5.0 | — | 1450 | 1 | 1 | 48 | 8 | 13 |
| 5.0 | 0.1 | — | — | 0.01 | — | 1300 | 5 | 1 | 37 | 9 | 15 |
| 5.0 | 0.1 | — | — | 5.0 | — | 1250 | 10 | 1 | 50 | 9 | 15 |
| 5.0 | 3.0 | — | — | 5.0 | — | 1350 | 2 | initial (5) | 305 | 9 | 14 |
| 5.0 | 3.0 | — | — | 5.0 | — | 1350 | 2 | 3 | 180 | 9 | 15 |
| 5.0 | 3.0 | — | — | 5.0 | — | 1350 | 2 | 1 | 60 | 9 | 15 |
| 0.5 | 0.5 | — | — | 0.5 | — | 1000 | 20 | initial (5) | 127 | 8 | 15 |
| 0.5 | 0.5 | — | — | 0.5 | — | 1000 | 20 | 3 | 76 | 8 | 15 |
| 0.5 | 0.5 | — | — | 0.5 | — | 1000 | 20 | 1 | 25 | 8 | 15 |
| 0.5 | 0.5 | — | — | 0.5 | — | 1200 | 8 | initial (5) | 120 | 8 | 14 |
| 0.5 | 0.5 | — | — | 0.5 | — | 1200 | 8 | 3 | 73 | 8 | 14 |

Table 1-continued

| Additives (mole %) | | | | | | Sintering condition | | | Characteristics of Resultant Resistor | | |
|---|---|---|---|---|---|---|---|---|---|---|---|
| $Bi_2O_3$ | $TiO_2$ | $AlF_3$ | $CrF_3$ | $NiF_2$ | SrO | Temp. (° C) | Time (hrs) | Thickness (mm) | C (V) at 10mA | $n_1$ | $n_2$ |
| 0.5 | 0.5 | — | — | 0.5 | — | 1200 | 8 | 1 | 24 | 8 | 14 |
| 0.5 | 0.5 | — | — | 0.5 | — | 1350 | 1 | initial (5) | 112 | 7 | 14 |
| 0.5 | 0.5 | — | — | 0.5 | — | 1350 | 1 | 3 | 66 | 7 | 14 |
| 0.5 | 0.5 | — | — | 0.5 | — | 1350 | 1 | 1 | 22 | 7 | 14 |
| 0.1 | 0.1 | — | — | — | 0.01 | 1000 | 10 | 1 | 25 | 6 | 10 |
| 0.1 | 0.1 | — | — | — | 5.0 | 1200 | 5 | 1 | 39 | 7 | 10 |
| 0.1 | 3.0 | — | — | — | 0.01 | 1300 | 2 | 1 | 42 | 7 | 11 |
| 5.0 | 3.0 | — | — | — | 5.0 | 1450 | 1 | 1 | 70 | 8 | 10 |
| 5.0 | 0.1 | — | — | — | 0.01 | 1300 | 1 | 1 | 38 | 7 | 10 |
| 5.0 | 0.1 | — | — | — | 5.0 | 1450 | 1 | 1 | 42 | 7 | 10 |
| 0.5 | 3.0 | — | — | — | 0.01 | 1300 | 5 | 1 | 35 | 7 | 10 |
| 0.5 | 3.0 | — | — | — | 5.0 | 1250 | 10 | 1 | 57 | 8 | 11 |
| 0.5 | 0.5 | — | — | — | 0.5 | 1350 | 1 | initial (5) | 151 | 7 | 10 |
| 0.5 | 0.5 | — | — | — | 0.5 | 1350 | 1 | 3 | 90 | 7 | 10 |
| 0.5 | 0.5 | — | — | — | 0.5 | 1350 | 1 | 1 | 30 | 7 | 10 |
| 0.1 | 0.1 | 0.01 | 0.01 | — | — | 1050 | 10 | 1 | 21 | 7 | 10 |
| 0.1 | 0.1 | 0.01 | 5.0 | — | — | 1250 | 5 | 1 | 40 | 8 | 11 |
| 5.0 | 3.0 | 3.0 | 0.01 | — | — | 1350 | 2 | 1 | 55 | 8 | 11 |
| 5.0 | 3.0 | 3.0 | 5.0 | — | — | 1350 | 2 | 1 | 75 | 8 | 10 |
| 0.5 | 0.5 | 0.5 | 0.5 | — | — | 1350 | 1 | initial (5) | 155 | 7 | 11 |
| 0.5 | 0.5 | 0.5 | 0.5 | — | — | 1350 | 1 | 3 | 91 | 7 | 11 |
| 0.5 | 0.5 | 0.5 | 0.5 | — | — | 1350 | 1 | 1 | 30 | 7 | 11 |
| 0.1 | 0.1 | 0.01 | — | 0.01 | — | 1000 | 10 | 1 | 10 | 7 | 11 |
| 0.1 | 0.1 | 0.01 | — | 5.0 | — | 1200 | 5 | 1 | 25 | 8 | 12 |
| 5.0 | 3.0 | 3.0 | — | 0.01 | — | 1450 | 1 | 1 | 37 | 8 | 12 |
| 5.0 | 3.0 | 3.0 | — | 5.0 | — | 1450 | 1 | 1 | 55 | 8 | 11 |
| 0.5 | 0.5 | 0.5 | — | 0.5 | — | 1350 | 1 | initial (5) | 111 | 9 | 12 |
| 0.5 | 0.5 | 0.5 | — | 0.5 | — | 1350 | 1 | 3 | 66 | 9 | 12 |
| 0.5 | 0.5 | 0.5 | — | 0.5 | — | 1350 | 1 | 1 | 22 | 9 | 12 |
| 0.1 | 0.1 | 0.01 | — | — | 0.01 | 1000 | 10 | 1 | 18 | 6 | 10 |
| 0.1 | 0.1 | 0.01 | — | — | 5.0 | 1200 | 5 | 1 | 35 | 7 | 10 |
| 5.0 | 3.0 | 3.0 | — | — | 0.01 | 1450 | 1 | 1 | 49 | 7 | 11 |
| 5.0 | 3.0 | 3.0 | — | — | 5.0 | 1450 | 1 | 1 | 74 | 7 | 11 |
| 0.5 | 0.5 | 0.5 | — | — | 0.5 | 1350 | 1 | initial (5) | 164 | 6 | 10 |
| 0.5 | 0.5 | 0.5 | — | — | 0.5 | 1350 | 1 | 3 | 99 | 6 | 10 |
| 0.5 | 0.5 | 0.5 | — | — | 0.5 | 1350 | 1 | 1 | 33 | 6 | 10 |
| 0.1 | 0.1 | — | 0.01 | 0.01 | — | 1000 | 10 | 1 | 5 | 1 | 14 |
| 0.1 | 0.1 | — | 5.0 | 0.01 | — | 1250 | 5 | 1 | 20 | 10 | 15 |
| 0.1 | 0.1 | — | 0.01 | 5.0 | — | 1350 | 1 | 1 | 19 | 10 | 15 |
| 0.1 | 3.0 | — | 0.01 | 0.01 | — | 1350 | 1 | 1 | 22 | 10 | 14 |
| 5.0 | 0.1 | — | 0.01 | 0.01 | — | 1200 | 5 | 1 | 24 | 9 | 14 |
| 0.1 | 0.1 | — | 5.0 | 5.0 | — | 1450 | 1 | 1 | 35 | 10 | 15 |
| 0.1 | 3.0 | — | 5.0 | 0.01 | — | 1450 | 1 | 1 | 38 | 10 | 14 |
| 5.0 | 0.1 | — | 5.0 | 0.01 | — | 1350 | 2 | 1 | 40 | 10 | 15 |
| 0.1 | 3.0 | — | 0.01 | 5.0 | — | 1250 | 10 | 1 | 40 | 10 | 14 |
| 5.0 | 0.1 | — | 0.01 | 5.0 | — | 1300 | 2 | 1 | 37 | 9 | 15 |
| 5.0 | 3.0 | — | 0.01 | 0.01 | — | 1350 | 1 | 1 | 38 | 10 | 15 |
| 0.1 | 3.0 | — | 5.0 | 5.0 | — | 1350 | 1 | 1 | 45 | 10 | 14 |
| 5.0 | 0.1 | — | 5.0 | 5.0 | — | 1350 | 3 | 1 | 48 | 9 | 14 |
| 5.0 | 3.0 | — | 5.0 | 0.01 | — | 1450 | 1 | 1 | 50 | 10 | 15 |
| 5.0 | 3.0 | — | 0.01 | 5.0 | — | 1450 | 1 | 1 | 52 | 10 | 15 |
| 5.0 | 3.0 | — | 5.0 | 5.0 | — | 1450 | 2 | 1 | 69 | 9 | 15 |
| 0.5 | 0.5 | — | 0.5 | 0.5 | — | 1350 | 1 | initial (5) | 102 | 10 | 15 |
| 0.5 | 0.5 | — | 0.5 | 0.5 | — | 1350 | 1 | 3 | 60 | 10 | 15 |
| 0.5 | 0.5 | — | 0.5 | 0.5 | — | 1350 | 1 | 1 | 20 | 10 | 15 |
| 0.1 | 0.1 | — | 0.01 | — | 0.01 | 1000 | 10 | 1 | 11 | 6 | 10 |
| 0.1 | 0.1 | — | 0.01 | — | 5.0 | 1300 | 2 | 1 | 25 | 7 | 11 |
| 5.0 | 3.0 | — | 5.0 | — | 0.01 | 1250 | 5 | 1 | 33 | 7 | 11 |
| 5.0 | 3.0 | — | 5.0 | — | 5.0 | 1450 | 1 | 1 | 69 | 8 | 11 |
| 0.5 | 0.5 | — | 0.5 | — | 0.5 | 1350 | 1 | initial (5) | 109 | 6 | 10 |
| 0.5 | 0.5 | — | 0.5 | — | 0.5 | 1350 | 1 | 3 | 67 | 6 | 10 |
| 0.5 | 0.5 | — | 0.5 | — | 0.5 | 1350 | 1 | 1 | 22 | 6 | 10 |
| 0.1 | 0.1 | — | — | 0.01 | 0.01 | 1000 | 10 | 1 | 15 | 7 | 12 |
| 0.1 | 0.5 | — | — | 0.01 | 5.0 | 1250 | 5 | 1 | 25 | 8 | 13 |
| 5.0 | 3.0 | — | — | 5.0 | 0.01 | 1400 | 1 | 1 | 45 | 9 | 13 |
| 5.0 | 3.0 | — | — | 5.0 | 5.0 | 1450 | 1 | 1 | 70 | 9 | 13 |
| 0.5 | 0.5 | — | — | 0.5 | 0.5 | 1350 | 1 | initial (5) | 105 | 8 | 12 |
| 0.5 | 0.5 | — | — | 0.5 | 0.5 | 1350 | 1 | 3 | 61 | 8 | 12 |
| 0.5 | 0.5 | — | — | 0.5 | 0.5 | 1350 | 1 | 1 | 20 | 8 | 12 |

Table 2

| Additives (mole %) | | | | | | | | Characteristics of Resultant Resistor | | | Change Rate after Impulse Test (%) | | | Change Rate after D.C. Load Life Test (%) | | |
|---|---|---|---|---|---|---|---|---|---|---|---|---|---|---|---|---|
| $Bi_2O_3$ | CoO | MnO | $TiO_2$ | $NiF_2$ | $Al F_3$ | $CrF_3$ | SrO | C (V) at 10mA | $n_1$ | $n_2$ | ΔC at 1mA | $\Delta n_2$ | $\Delta n_2$ | ΔC at 10mA | $\Delta n_1$ | $\Delta n_2$ |
| 0.1 | 0.1 | — | 0.1 | 0.01 | — | — | — | 18 | 11 | 11 | +10 | −9.3 | −8.2 | −9.5 | −9.6 | −8.1 |
| 0.1 | 3.0 | — | 0.1 | 0.01 | — | — | — | 21 | 11 | 16 | +9.2 | −8.5 | −7.4 | −9.3 | −8.7 | −7.5 |
| 0.1 | 0.1 | — | 0.1 | 0.5 | — | — | — | 30 | 11 | 16 | +7.3 | −6.6 | −5.5 | −7.5 | −8.6 | −5.6 |
| 0.1 | 0.1 | — | 3.0 | 0.01 | — | — | — | 31 | 11 | 16 | +8.0 | −7.4 | −6.3 | −8.0 | −7.9 | −6.3 |
| 5.0 | 0.1 | — | 0.1 | 0.01 | — | — | — | 29 | 11 | 16 | +8.5 | −8.0 | −6.9 | −8.6 | −8.2 | −6.7 |
| 0.1 | 3.0 | — | 0.1 | 5.0 | — | — | — | 42 | 11 | 16 | +7.1 | −7.0 | −5.9 | −7.6 | −7.5 | −5.9 |
| 0.1 | 3.0 | — | 3.0 | 0.01 | — | — | — | 40 | 12 | 17 | +8.9 | −8.3 | −7.2 | −8.8 | −8.4 | −7.5 |

Table 2-continued

| Additives (mole %) | | | | | | | | Characteristics of Resultant Resistor | | | Change Rate after Impulse Test (%) | | | Change Rate after D.C. Load Life Test (%) | | |
|---|---|---|---|---|---|---|---|---|---|---|---|---|---|---|---|---|
| $Bi_2O_3$ | CoO | MnO | $TiO_2$ | $NiF_2$ | $AlF_3$ | $CrF_3$ | SrO | C (V) at 10mA | $n_1$ | $n_2$ | ΔC at 1mA | $\Delta n_2$ | $\Delta n_2$ | ΔC at 10mA | $\Delta n_1$ | $\Delta n_2$ |
| 5.0 | 3.0 | — | 0.1 | 0.01 | — | — | — | 35 | 11 | 16 | +8.5 | −7.9 | −6.7 | −8.7 | −7.9 | −6.0 |
| 0.1 | 0.1 | — | 3.0 | 5.0 | — | — | — | 38 | 11 | 16 | +7.2 | −6.5 | −5.4 | −7.5 | −6.2 | −7.2 |
| 5.0 | 0.1 | — | 0.1 | 5.0 | — | — | — | 40 | 12 | 17 | +9.4 | −8.8 | −7.6 | −9.5 | −8.9 | −5.8 |
| 5.0 | 0.1 | — | 3.0 | 0.01 | — | — | — | 52 | 12 | 16 | +9.5 | −8.6 | −7.7 | −9.3 | −8.8 | −5.6 |
| 0.1 | 3.0 | — | 3.0 | 5.0 | — | — | — | 68 | 12 | 17 | +7.2 | −6.6 | −5.6 | −7.7 | −6.9 | −7.7 |
| 5.0 | 3.0 | — | 0.1 | 5.0 | — | — | — | 50 | 12 | 16 | +7.0 | −6.7 | −5.8 | −7.4 | −7.2 | −7.6 |
| 5.0 | 3.0 | — | 3.0 | 0.01 | — | — | — | 52 | 12 | 17 | +8.3 | −8.4 | −7.2 | −8.5 | −8.5 | −5.4 |
| 5.0 | 0.1 | — | 3.0 | 5.0 | — | — | — | 60 | 12 | 17 | +7.4 | −7.1 | −6.0 | −7.4 | −7.3 | −6.7 |
| 5.0 | 3.0 | — | 3.0 | 5.0 | — | — | — | 63 | 12 | 17 | +9.5 | −8.6 | −7.5 | −9.2 | −8.9 | −7.2 |
| 0.5 | 0.5 | — | 0.5 | 0.5 | — | — | — | 30 | 12 | 19 | +5.0 | −5.0 | −4.1 | −5.0 | −5.1 | −4.3 |
| 0.1 | — | 0.1 | 0.1 | 0.01 | — | — | — | 15 | 13 | 17 | −5.2 | −9.8 | −8.4 | −9.6 | −7.6 | −6.8 |
| 0.1 | — | 3.0 | 0.1 | 0.01 | — | — | — | 20 | 14 | 18 | −4.6 | −9.2 | −7.8 | −9.4 | −7.4 | −6.1 |
| 0.1 | — | 0.1 | 0.1 | 5.0 | — | — | — | 35 | 15 | 17 | −3.8 | −8.4 | −7.0 | −8.6 | −9.5 | −8.0 |
| 0.1 | — | 0.1 | 3.0 | 0.01 | — | — | — | 32 | 15 | 17 | −4.3 | −8.9 | −7.6 | −8.8 | −8.2 | −6.9 |
| 5.0 | — | 0.1 | 0.1 | 0.01 | — | — | — | 30 | 14 | 17 | −5.0 | −9.2 | −7.9 | −8.7 | −7.9 | −6.6 |
| 0.1 | — | 3.0 | 0.1 | 5.0 | — | — | — | 47 | 15 | 18 | −3.7 | −8.4 | −7.1 | −8.6 | −8.4 | −7.2 |
| 0.1 | — | 3.0 | 3.0 | 0.01 | — | — | — | 42 | 15 | 18 | −4.6 | −8.7 | −7.3 | −8.5 | −8.0 | −6.7 |
| 5.0 | — | 3.0 | 0.1 | 0.01 | — | — | — | 40 | 14 | 18 | −4.2 | −8.6 | −7.2 | −7.9 | −8.5 | −7.2 |
| 0.1 | — | 0.1 | 3.0 | 5.0 | — | — | — | 45 | 15 | 17 | −3.9 | −8.5 | −7.1 | −8.5 | −8.7 | −7.3 |
| 5.0 | — | 0.1 | 0.1 | 5.0 | — | — | — | 48 | 15 | 16 | −3.6 | −8.0 | −6.5 | −9.2 | −8.8 | −7.4 |
| 5.0 | — | 0.1 | 3.0 | 0.01 | — | — | — | 51 | 15 | 16 | −4.3 | −8.5 | −7.1 | −7.5 | −8.5 | −7.1 |
| 0.1 | — | 3.0 | 3.0 | 5.0 | — | — | — | 60 | 16 | 18 | −3.5 | −7.9 | −6.4 | −7.6 | −9.1 | −7.9 |
| 5.0 | — | 3.0 | 0.1 | 5.0 | — | — | — | 57 | 16 | 18 | −3.4 | −8.1 | −6.8 | −8.4 | −8.9 | −7.6 |
| 5.0 | — | 3.0 | 3.0 | 0.01 | — | — | — | 58 | 16 | 18 | −5.0 | −9.5 | −8.0 | −7.9 | −8.3 | −7.0 |
| 5.0 | — | 0.1 | 3.0 | 5.0 | — | — | — | 62 | 15 | 17 | −3.8 | −7.4 | −6.1 | −8.6 | −9.2 | −7.8 |
| 5.0 | — | 3.0 | 3.0 | 5.0 | — | — | — | 69 | 16 | 18 | −3.9 | −7.3 | −6.7 | −9.3 | −9.8 | −8.4 |
| 0.5 | — | 0.5 | 0.5 | 0.5 | — | — | — | 41 | 18 | 20 | −1.8 | −5.9 | −4.5 | −6.0 | −5.5 | −4.6 |
| 0.1 | 0.1 | 0.1 | 0.1 | 0.01 | — | — | — | 20 | 30 | 21 | +4.8 | −5.0 | −4.0 | −4.5 | −5.0 | −3.9 |
| 0.1 | 3.0 | 0.1 | 0.1 | 0.01 | — | — | — | 32 | 30 | 21 | +4.5 | −4.7 | −3.7 | −4.7 | −4.8 | −3.7 |
| 0.1 | 0.1 | 3.0 | 0.1 | 0.01 | — | — | — | 34 | 31 | 22 | +4.7 | −4.9 | −3.8 | −4.8 | −4.6 | −3.7 |
| 0.1 | 3.0 | 3.0 | 0.1 | 0.01 | — | — | — | 52 | 32 | 22 | +4.0 | −4.2 | −3.3 | −4.2 | −4.4 | −3.5 |
| 0.5 | 0.1 | 0.1 | 0.5 | 0.5 | — | — | — | 27 | 30 | 21 | +3.9 | −4.1 | −3.1 | −2.5 | −4.1 | −3.3 |
| 0.5 | 3.0 | 0.1 | 0.5 | 0.5 | — | — | — | 33 | 33 | 22 | +4.4 | −4.6 | −3.7 | −3.9 | −4.4 | −3.4 |
| 0.5 | 0.1 | 3.0 | 0.5 | 0.5 | — | — | — | 45 | 35 | 22 | +4.2 | −4.4 | −3.3 | −2.6 | −4.6 | −3.7 |
| 0.5 | 3.0 | 3.0 | 0.5 | 0.5 | — | — | — | 50 | 36 | 22 | +3.8 | −4.1 | −3.2 | −3.8 | −4.1 | −3.2 |
| 0.5 | 0.5 | 0.5 | 0.5 | 0.5 | — | — | — | 35 | 38 | 24 | +3.0 | −2.0 | −1.5 | −0.4 | −2.1 | −1.6 |
| 5.0 | 0.1 | 0.1 | 3.0 | 5.0 | — | — | — | 58 | 36 | 21 | +4.0 | −4.3 | −3.5 | −3.2 | −4.2 | −3.4 |
| 5.0 | 3.0 | 0.1 | 3.0 | 5.0 | — | — | — | 65 | 36 | 21 | +4.5 | −4.7 | −3.7 | −3.5 | −4.9 | −3.7 |
| 5.0 | 0.1 | 3.0 | 3.0 | 5.0 | — | — | — | 70 | 35 | 22 | +4.7 | −4.9 | −3.6 | −4.7 | −4.8 | −3.8 |
| 5.0 | 3.0 | 3.0 | 3.0 | 5.0 | — | — | — | 74 | 34 | 22 | +4.9 | −5.0 | −4.0 | −4.2 | −4.9 | −4.0 |
| 0.1 | 0.1 | — | 0.1 | — | 0.01 | — | — | 13 | 15 | 16 | +9.5 | −8.7 | −8.3 | +9.5 | −9.2 | −9.6 |
| 5.0 | 3.0 | — | 3.0 | — | 5.0 | — | — | 72 | 16 | 16 | +5.8 | −6.3 | −6.5 | +8.9 | −9.5 | −8.3 |
| 0.5 | 0.5 | — | 0.5 | — | 0.5 | — | — | 40 | 18 | 19 | +2.0 | −5.1 | −5.4 | +6.5 | −5.3 | −4.6 |
| 0.1 | — | 0.1 | 0.1 | — | 0.01 | — | — | 20 | 16 | 16 | +8.2 | −9.5 | −7.9 | −9.0 | −9.5 | −9.3 |
| 5.0 | — | 3.0 | 3.0 | — | 5.0 | — | — | 72 | 16 | 17 | +7.1 | −8.3 | −7.2 | −9.2 | −9.3 | −9.4 |
| 0.5 | — | 0.5 | 0.5 | — | 0.5 | — | — | 80 | 18 | 19 | +3.5 | −5.6 | −5.1 | −6.4 | −6.2 | −6.1 |
| 0.1 | 0.1 | 0.1 | 0.1 | — | 0.01 | — | — | 11 | 30 | 21 | +7.9 | −4.4 | −3.8 | −7.2 | −3.8 | −3.1 |
| 5.0 | 3.0 | 3.0 | 3.0 | — | 5.0 | — | — | 58 | 31 | 22 | +6.4 | −3.8 | −3.2 | −8.9 | −3.6 | −2.9 |
| 0.5 | 0.5 | 0.5 | 0.5 | — | 0.5 | — | — | 17 | 35 | 24 | +4.1 | −2.3 | −1.7 | +0.5 | −2.5 | −1.5 |
| 0.1 | 0.1 | — | 0.1 | — | — | 0.01 | — | 15 | 11 | 16 | +9.2 | −9.3 | −8.3 | −9.6 | −8.6 | −9.2 |
| 0.1 | 3.0 | — | 0.1 | — | — | 0.01 | — | 26 | 11 | 16 | +7.4 | −7.3 | −7.4 | −9.5 | −8.6 | −8.7 |
| 5.0 | 0.1 | — | 3.0 | — | — | 5.0 | — | 52 | 11 | 17 | +8.3 | −8.5 | −8.4 | −8.2 | −8.5 | −8.4 |
| 5.0 | 3.0 | — | 3.0 | — | — | 5.0 | — | 73 | 11 | 17 | +9.1 | −9.0 | −9.1 | −9.0 | −8.02 | −8.0 |
| 0.5 | 0.1 | — | 0.5 | — | — | 0.5 | — | 22 | 11 | 16 | +8.5 | −8.1 | −8.0 | −7.5 | −7.9 | −7.2 |
| 0.5 | 0.5 | — | 0.5 | — | — | 0.5 | — | 38 | 11 | 20 | +5.5 | −5.4 | −5.3 | −6.0 | −5.2 | −4.5 |
| 0.5 | 3.0 | — | 0.5 | — | — | 0.5 | — | 41 | 11 | 17 | +7.4 | −7.3 | −7.5 | −7.9 | −7.6 | −7.0 |
| 0.1 | — | 0.1 | 0.1 | — | — | 0.01 | — | 12 | 15 | 16 | −9.7 | −9.6 | −9.7 | −9.8 | −9.2 | −8.4 |
| 0.1 | — | 3.0 | 0.1 | — | — | 0.01 | — | 30 | 15 | 16 | −9.4 | −9.2 | −9.4 | −9.5 | −9.0 | −9.0 |
| 0.5 | — | 0.1 | 0.5 | — | — | 0.5 | — | 28 | 15 | 16 | −8.3 | −8.3 | −8.5 | −8.9 | −8.6 | −7.5 |
| 0.5 | — | 0.5 | 0.5 | — | — | 0.5 | — | 75 | 17 | 19 | −6.0 | −3.6 | −5.4 | −7.0 | −5.9 | −4.2 |
| 0.5 | — | 3.0 | 0.5 | — | — | 0.5 | — | 78 | 16 | 17 | −7.9 | −7.8 | −7.7 | −8.0 | −8.2 | −6.3 |
| 5.0 | — | 0.1 | 3.0 | — | — | 5.0 | — | 70 | 16 | 17 | −8.4 | −8.5 | −8.3 | −9.0 | −8.1 | −7.3 |
| 5.0 | — | 3.0 | 3.0 | — | — | 5.0 | — | 73 | 16 | 17 | −8.7 | −8.8 | −8.7 | −9.7 | −8.5 | −8.1 |
| 0.1 | 0.1 | 0.1 | 0.1 | — | — | 0.01 | — | 8 | 25 | 21 | +5.0 | −4.9 | −3.6 | −4.2 | −4.9 | −4.0 |
| 0.1 | 3.0 | 0.1 | 0.1 | — | — | 0.01 | — | 25 | 30 | 21 | +4.9 | +4.7 | −3.7 | −4.7 | −4.8 | −3.8 |
| 0.1 | 0.1 | 3.0 | 0.1 | — | — | 0.01 | — | 22 | 30 | 21 | +4.9 | −4.8 | −3.7 | −3.5 | −4.9 | −3.7 |
| 0.1 | 3.0 | 3.0 | 0.1 | — | — | 0.01 | — | 38 | 31 | 22 | +5.0 | +3.1 | −2.4 | −3.2 | −4.3 | −3.4 |
| 0.5 | 0.1 | 0.1 | 0.5 | — | — | 0.5 | — | 20 | 30 | 21 | +4.6 | −3.0 | −2.9 | −3.8 | −4.4 | −3.7 |
| 0.5 | 3.0 | 0.1 | 0.5 | — | — | 0.5 | — | 27 | 30 | 22 | +4.8 | −3.7 | −3.3 | −2.6 | −4.6 | −3.2 |
| 0.5 | 0.1 | 3.0 | 0.5 | — | — | 0.5 | — | 30 | 30 | 22 | +4.5 | −3.4 | −3.5 | −3.9 | −4.2 | −3.4 |
| 0.5 | 3.0 | 3.0 | 0.5 | — | — | 0.5 | — | 48 | 32 | 22 | +4.7 | −4.0 | −3.2 | −3.9 | −4.1 | −3.5 |
| 0.5 | 0.5 | 0.5 | 0.5 | — | — | 0.5 | — | 40 | 37 | 24 | +4.1 | −2.2 | −1.5 | −0.5 | −2.1 | −1.6 |
| 5.0 | 0.1 | 0.1 | 3.0 | — | — | 5.0 | — | 50 | 33 | 22 | +4.6 | −3.8 | −2.9 | −2.5 | −4.7 | −3.2 |
| 5.0 | 3.0 | 0.1 | 3.0 | — | — | 5.0 | — | 62 | 33 | 22 | +4.8 | −3.9 | −2.8 | −4.2 | −4.6 | −3.8 |
| 5.0 | 0.1 | 3.0 | 3.0 | — | — | 5.0 | — | 67 | 33 | 21 | +4.7 | −4.2 | −3.5 | −4.8 | −4.8 | −3.7 |
| 5.0 | 3.0 | 3.0 | 3.0 | — | — | 5.0 | — | 76 | 34 | 21 | +5.0 | −4.8 | −3.4 | −4.7 | −5.0 | −3.9 |
| 0.1 | 0.1 | — | 0.1 | — | — | — | 0.01 | 7 | 11 | 16 | +10 | −10 | −9.1 | −9.5 | −9.7 | −9.5 |
| 0.5 | 0.5 | — | 0.5 | — | — | — | 0.5 | 15 | 11 | 18 | −9.8 | −6.2 | −5.4 | −8.0 | −5.5 | −4.8 |
| 5.0 | 3.0 | — | 3.0 | — | — | — | 5.0 | 58 | 11 | 16 | +9.9 | −8.9 | −8.7 | −9.7 | −9.1 | −8.9 |
| 0.1 | — | 0.1 | 0.1 | — | — | — | 0.01 | 21 | 11 | 17 | −7.2 | −9.6 | −9.3 | −9.6 | −9.9 | −9.2 |
| 0.5 | — | 0.5 | 0.5 | — | — | — | 0.5 | 50 | 11 | 19 | −4.0 | −6.3 | −6.0 | −7.0 | −6.5 | −6.1 |
| 5.0 | — | 3.0 | 3.0 | — | — | — | 5.0 | 73 | 11 | 17 | −6.9 | −9.2 | −8.8 | −9.0 | −10 | −9.2 |
| 0.1 | 0.1 | 0.1 | 0.1 | — | — | — | 0.01 | 9 | 25 | 21 | +4.9 | −4.8 | −3.8 | −3.3 | −3.7 | −3.5 |
| 0.5 | 0.5 | 0.5 | 0.5 | — | — | — | 0.5 | 18 | 35 | 24 | +4.1 | −2.5 | −1.5 | +0.5 | −2.1 | −2.0 |
| 5.0 | 3.0 | 3.0 | 3.0 | — | — | — | 5.0 | 38 | 31 | 22 | +4.5 | −4.6 | −3.4 | −4.4 | −3.1 | −3.9 |
| 0.1 | 0.1 | — | 0.1 | 0.01 | 0.01 | — | — | 10 | 11 | 16 | +9.3 | −8.3 | −9.3 | −8.6 | −8.5 | −9.1 |

Table 2-continued

| Additives (mole %) | | | | | | | | Characteristics of Resultant Resistor | | | Change Rate after Impulse Test (%) | | | Change Rate after D.C. Load Life Test (%) | | |
|---|---|---|---|---|---|---|---|---|---|---|---|---|---|---|---|---|
| $Bi_2O_3$ | CoO | MnO | $TiO_2$ | $NiF_2$ | $AlF_3$ | $CrF_3$ | SrO | C (V) at 10mA | $n_1$ | $n_2$ | ΔC at 1mA | $\Delta n_2$ | $\Delta n_2$ | ΔC at 10mA | $\Delta n_1$ | $\Delta n_2$ |
| 0.1 | 0.5 | — | 0.1 | 0.01 | 0.01 | — | — | 11 | 11 | 16 | +7.4 | −7.7 | −8.7 | −8.5 | −8.7 | −8.6 |
| 0.1 | 3.0 | — | 0.1 | 0.01 | 0.01 | — | — | 12 | 11 | 17 | +8.4 | −7.2 | −8.2 | −7.2 | −8.3 | −8.3 |
| 0.5 | 0.1 | — | 0.5 | 0.5 | 0.5 | — | — | 20 | 19 | 19 | +9.1 | −7.5 | −8.5 | −8.1 | −8.0 | −7.9 |
| 0.5 | 0.5 | — | 0.5 | 0.5 | 0.5 | — | — | 38 | 17 | 16 | +8.5 | −6.1 | −7.1 | −5.2 | −5.0 | −4.2 |
| 0.5 | 3.0 | — | 0.5 | 0.5 | 0.5 | — | — | 40 | 17 | 17 | −4.8 | −4.8 | −7.2 | −7.7 | −7.0 | |
| | | | | | | | | | | +5.5 | | | | | | |
| 5.0 | 0.1 | — | 3.0 | 5.0 | 5.0 | — | — | 48 | 18 | 16 | +8.3 | −8.4 | −8.5 | −7.0 | −7.5 | −7.2 |
| 5.0 | 0.5 | — | 3.0 | 5.0 | 5.0 | — | — | 55 | 15 | 17 | +7.8 | −8.8 | −9.8 | −8.5 | −8.2 | −7.3 |
| 5.0 | 3.0 | — | 3.0 | 5.0 | 5.0 | — | — | 72 | 14 | 17 | +8.9 | −8.1 | −9.2 | −9.3 | −8.4 | −8.4 |
| 0.1 | — | 0.1 | 0.1 | 0.01 | 0.01 | — | — | 7 | 11 | 16 | −9.7 | −9.4 | −8.4 | −7.7 | −7.6 | −8.2 |
| 0.1 | — | 0.5 | 0.1 | 0.01 | 0.01 | — | — | 8 | 13 | 16 | −9.5 | −9.0 | −8.2 | −7.5 | −7.4 | −8.0 |
| 0.1 | — | 3.0 | 0.1 | 0.01 | 0.01 | — | — | 8 | 12 | 17 | −8.6 | −8.9 | −7.9 | −7.3 | −7.2 | −7.9 |
| 0.5 | — | 0.1 | 0.5 | 0.5 | 0.5 | — | — | 18 | 13 | 17 | −8.4 | −8.7 | −7.5 | −7.0 | −6.9 | −7.4 |
| 0.5 | — | 0.5 | 0.5 | 0.5 | 0.5 | — | — | 35 | 19 | 19 | −6.2 | −6.3 | −4.6 | −4.1 | −4.0 | −4.5 |
| 0.5 | — | 3.0 | 0.5 | 0.5 | 0.5 | — | — | 39 | 15 | 17 | −7.9 | −8.5 | −7.7 | −6.9 | −6.9 | −7.4 |
| 5.0 | — | 0.1 | 3.0 | 5.0 | 5.0 | — | — | 45 | 16 | 17 | −8.3 | −8.6 | −7.5 | −8.3 | −8.2 | −8.7 |
| 5.0 | — | 0.5 | 3.0 | 5.0 | 5.0 | — | — | 52 | 15 | 17 | −8.8 | −8.8 | −7.4 | −8.1 | −8.4 | −9.1 |
| 5.0 | — | 3.0 | 3.0 | 5.0 | 5.0 | — | — | 67 | 14 | 16 | −9.1 | −9.2 | −8.2 | −9.4 | −9.5 | −9.6 |
| 0.1 | 0.1 | 0.1 | 0.1 | 0.01 | 0.01 | — | — | 10 | 25 | 21 | +4.7 | −4.7 | −3.6 | −4.0 | −4.7 | −4.3 |
| 0.1 | 0.5 | 0.1 | 0.1 | 0.01 | 0.01 | — | — | 18 | 25 | 21 | +4.0 | −4.1 | −3.4 | −4.5 | −4.7 | −4.2 |
| 0.1 | 3.0 | 0.1 | 0.1 | 0.01 | 0.01 | — | — | 29 | 26 | 21 | +3.9 | −3.8 | −3.2 | −3.0 | −4.8 | −4.4 |
| 0.5 | 0.1 | 0.5 | 0.5 | 0.5 | 0.5 | — | — | 25 | 26 | 21 | +3.8 | −3.9 | −3.3 | −3.4 | −4.1 | −4.0 |
| 0.5 | 0.5 | 0.5 | 0.5 | 0.5 | 0.5 | — | — | 33 | 30 | 24 | +2.7 | −2.4 | −1.9 | −1.8 | −2.5 | −2.2 |
| 0.5 | 3.0 | 0.5 | 0.5 | 0.5 | 0.5 | — | — | 42 | 26 | 21 | +3.7 | −3.6 | −3.5 | −3.7 | −3.6 | −3.5 |
| 5.0 | 0.1 | 3.0 | 3.0 | 5.0 | 5.0 | — | — | 43 | 26 | 21 | +3.9 | −3.7 | −3.8 | −3.6 | −4.5 | −3.9 |
| 5.0 | 0.5 | 3.0 | 3.0 | 5.0 | 5.0 | — | — | 50 | 26 | 22 | +4.1 | −4.3 | −3.9 | −2.9 | −3.9 | −4.0 |
| 5.0 | 3.0 | 3.0 | 3.0 | 5.0 | 5.0 | — | — | 75 | 27 | 22 | +4.6 | −4.5 | −4.9 | −3.6 | −4.4 | −3.9 |
| 0.1 | 3.0 | 3.0 | 0.1 | 0.01 | 0.01 | — | — | 60 | 27 | 22 | +4.9 | −4.7 | −4.8 | −3.3 | −4.5 | −4.1 |
| 5.0 | 0.1 | 0.1 | 3.0 | 5.0 | 5.0 | — | — | 52 | 25 | 21 | +5.0 | −4.8 | −4.1 | −3.7 | −4.7 | −4.3 |
| 0.1 | 0.1 | — | 0.1 | 0.01 | — | 0.01 | — | 13 | 11 | 16 | +9.6 | −9.0 | −8.8 | −7.6 | −8.5 | −7.5 |
| 0.1 | 0.5 | — | 0.1 | 0.01 | — | 0.01 | — | 28 | 11 | 16 | +8.4 | −8.5 | −8.3 | −7.5 | −8.4 | −8.9 |
| 0.1 | 3.0 | — | 0.1 | 0.01 | — | 0.01 | — | 47 | 11 | 17 | +7.9 | −7.3 | −7.1 | −6.2 | −8.3 | −7.6 |
| 0.5 | 0.5 | — | 0.5 | 0.5 | — | 0.5 | — | 35 | 11 | 19 | +3.4 | −5.1 | −4.9 | −4.0 | −5.1 | −4.4 |
| 5.0 | 0.1 | — | 3.0 | 5.0 | — | 5.0 | — | 39 | 11 | 17 | +6.9 | −9.1 | −9.0 | −7.0 | −8.0 | −7.2 |
| 5.0 | 0.5 | — | 3.0 | 5.0 | — | 5.0 | — | 48 | 11 | 17 | +7.3 | −8.3 | −8.2 | −5.5 | −7.7 | −6.9 |
| 5.0 | 3.0 | — | 3.0 | 5.0 | — | 5.0 | — | 75 | 11 | 16 | +8.5 | −7.9 | −7.6 | −5.9 | −7.2 | −8.4 |
| 0.1 | — | 0.1 | — | 0.01 | — | 0.01 | — | 20 | 11 | 16 | +8.6 | −9.8 | −9.1 | −7.2 | −7.8 | −6.4 |
| 0.1 | — | 0.5 | — | 0.01 | — | 0.01 | — | 32 | 11 | 16 | +7.4 | −8.5 | −7.5 | −7.0 | −7.5 | −7.0 |
| 0.1 | — | 3.0 | — | 0.01 | — | 0.01 | — | 46 | 11 | 17 | +6.3 | −6.3 | −6.3 | −6.6 | −6.9 | −6.7 |
| 0.5 | — | 0.5 | — | 0.5 | — | 0.5 | — | 41 | 13 | 19 | +2.5 | −5.4 | −4.9 | −3.0 | −5.4 | −4.5 |
| 3.0 | — | 0.1 | — | 5.0 | — | 5.0 | — | 45 | 11 | 16 | +6.7 | −6.5 | −7.3 | −6.2 | −6.8 | −6.6 |
| 3.0 | — | 0.5 | — | 5.0 | — | 5.0 | — | 50 | 11 | 17 | +7.2 | −8.2 | −8.1 | −6.1 | −7.0 | −7.5 |
| 3.0 | — | 3.0 | — | 5.0 | — | 5.0 | — | 61 | 12 | 16 | +7.9 | −9.0 | −9.2 | −6.5 | −7.7 | −7.2 |
| 0.1 | 0.1 | 0.1 | 0.1 | 0.1 | — | 0.01 | — | 20 | 38 | 20 | +4.2 | −4.3 | −4.0 | −2.5 | −3.0 | −3.1 |
| 0.5 | 0.1 | 0.1 | 0.5 | 0.5 | — | 0.5 | — | 33 | 38 | 21 | +4.6 | −4.7 | −4.5 | −2.2 | −2.6 | −2.5 |
| 0.5 | 3.0 | 0.1 | 0.5 | 0.5 | — | 0.5 | — | 40 | 38 | 21 | +3.9 | −4.0 | −3.7 | −2.1 | −2.3 | −2.4 |
| 0.5 | 0.1 | 3.0 | 0.5 | 0.5 | — | 0.5 | — | 42 | 39 | 21 | +3.7 | −3.9 | −3.5 | −2.4 | −2.5 | −2.6 |
| 0.5 | 3.0 | 3.0 | 0.5 | 0.5 | — | 0.5 | — | 50 | 40 | 22 | +3.5 | −3.4 | −3.0 | −2.0 | −2.2 | −2.4 |
| 0.5 | 0.5 | 0.5 | 0.5 | 0.5 | — | 0.5 | — | 38 | 42 | 24 | +2.5 | −2.2 | −2.0 | −0.6 | −0.5 | −0.4 |
| 5.0 | 3.0 | 3.0 | 3.0 | 5.0 | — | 5.0 | — | 67 | 39 | 22 | +4.1 | −3.9 | −3.7 | −2.3 | −2.4 | −2.5 |
| 0.1 | 0.1 | — | 0.1 | 0.01 | — | — | 0.01 | 18 | 11 | 16 | +9.8 | −8.8 | −8.6 | −9.5 | −8.4 | −8.8 |
| 0.5 | 0.1 | — | 0.5 | 0.5 | — | — | 0.5 | 21 | 12 | 17 | +8.6 | −7.7 | −7.3 | −7.6 | −9.0 | −7.6 |
| 0.5 | 0.5 | — | 0.5 | 0.5 | — | — | 0.5 | 25 | 15 | 19 | +5.5 | −5.6 | −5.4 | −4.2 | −5.5 | −5.3 |
| 0.5 | 3.0 | — | 0.5 | 0.5 | — | — | 0.5 | 40 | 13 | 16 | +7.9 | −7.2 | −7.0 | −6.9 | −8.5 | −7.7 |
| 5.0 | 3.0 | — | 3.0 | 5.0 | — | — | 5.0 | 52 | 12 | 17 | +8.7 | −8.5 | −8.4 | −8.7 | −9.3 | −8.1 |
| 0.1 | — | 0.1 | 0.1 | 0.01 | — | — | 0.01 | 20 | 12 | 16 | −9.2 | −9.1 | −8.9 | −9.3 | −9.5 | −9.2 |
| 0.5 | — | 0.1 | 0.5 | 0.5 | — | — | 0.5 | 25 | 13 | 16 | −8.7 | −8.8 | −8.8 | −7.3 | −7.6 | −7.3 |
| 0.5 | — | 0.5 | 0.5 | 0.5 | — | — | 0.5 | 33 | 16 | 19 | −5.3 | −5.4 | −5.4 | −3.9 | −3.7 | −3.5 |
| 0.5 | — | 3.0 | 0.5 | 0.5 | — | — | 0.5 | 45 | 12 | 16 | −8.6 | −8.6 | −8.4 | −8.5 | −8.6 | −8.2 |
| 5.0 | — | 3.0 | 3.0 | 5.0 | — | — | 5.0 | 60 | 11 | 17 | −8.9 | −9.0 | −9.1 | −9.2 | −9.5 | −9.1 |
| 0.1 | 0.1 | 0.1 | 0.1 | 0.01 | — | — | 0.01 | 19 | 19 | 20 | −4.5 | −4.2 | −4.0 | −3.0 | −2.9 | −2.9 |
| 0.5 | 0.1 | 3.0 | 0.5 | 0.5 | — | — | 0.5 | 23 | 22 | 20 | −3.6 | −3.4 | −3.2 | −2.9 | −2.7 | −2.8 |
| 0.5 | 3.0 | 0.1 | 0.5 | 0.5 | — | — | 0.5 | 30 | 23 | 21 | −3.3 | −3.4 | −3.1 | −2.7 | −2.6 | −2.9 |
| 0.5 | 3.0 | 3.0 | 0.5 | 0.5 | — | — | 0.5 | 42 | 25 | 22 | −3.8 | −3.6 | −3.8 | −2.2 | −2.3 | −2.5 |
| 0.5 | 0.5 | 0.5 | 0.5 | 0.5 | — | — | 0.5 | 32 | 30 | 24 | −1.8 | −1.9 | −1.5 | −0.5 | −0.8 | −1.0 |
| 5.0 | 3.0 | 3.0 | 3.0 | 5.0 | — | — | 5.0 | 58 | 25 | 22 | −4.0 | −4.5 | −4.7 | −2.0 | −2.4 | −2.2 |
| 0.1 | 0.1 | — | 0.1 | −0.01 | 0.01 | — | 13 | 11 | 16 | +9.7 | −9.8 | −9.7 | −9.6 | −9.3 | −8.6 | |
| 0.5 | 0.1 | — | 0.5 | — | 0.5 | 0.5 | — | 21 | 11 | 16 | +8.6 | −9.2 | −9.1 | −8.7 | −8.3 | −9.4 |
| 0.5 | 0.5 | — | 0.5 | — | 0.5 | 0.5 | — | 33 | 15 | 19 | +5.4 | −5.6 | −5.4 | −4.3 | −3.9 | −5.2 |
| 0.5 | 3.0 | — | 0.5 | — | 0.5 | 0.5 | — | 48 | 12 | 16 | +7.8 | −8.2 | −8.1 | −7.0 | −8.8 | −7.5 |
| 5.0 | 3.0 | — | 3.0 | — | 5.0 | 5.0 | — | 65 | 12 | 17 | +8.5 | −7.9 | −7.9 | −8.8 | −9.6 | −7.9 |
| 0.1 | — | 0.1 | 0.1 | — | 0.01 | 0.01 | — | 15 | 11 | 17 | +9.3 | −9.1 | −9.1 | −9.4 | −8.6 | −9.4 |
| 0.5 | — | 0.1 | 0.5 | — | 0.5 | 0.5 | — | 22 | 13 | 17 | +8.8 | −8.6 | −8.4 | −7.4 | −9.1 | −7.2 |
| 0.5 | — | 0.5 | 0.5 | — | 0.5 | 0.5 | — | 38 | 18 | 19 | +5.4 | −5.2 | −5.0 | −3.7 | −5.5 | −3.4 |
| 0.5 | — | 3.0 | 0.5 | — | 0.5 | 0.5 | — | 50 | 15 | 17 | +8.6 | −8.4 | −8.2 | −8.7 | −8.6 | −8.1 |
| 5.0 | — | 3.0 | 3.0 | — | 5.0 | 5.0 | — | 69 | 14 | 17 | +8.9 | −8.6 | −8.7 | −9.4 | −9.4 | −9.4 |
| 0.1 | 0.1 | 0.1 | 0.1 | — | 0.01 | 0.01 | — | 19 | 20 | 20 | +4.5 | −4.2 | −4.0 | −2.9 | −3.0 | −2.8 |
| 0.5 | 0.1 | 3.0 | 0.5 | — | 0.5 | 0.5 | — | 30 | 22 | 22 | +3.7 | −3.5 | −3.6 | −2.8 | −2.8 | −2.7 |
| 0.5 | 3.0 | 0.1 | 0.5 | — | 0.5 | 0.5 | —48 | 25 | 22 | +3.4 | −3.2 | −3.4 | −2.7 | −2.6 | −2.9 | |
| 0.5 | 3.0 | 3.0 | 0.5 | — | 0.5 | 0.5 | — | 63 | 25 | 22 | +3.8 | −3.7 | −3.9 | −2.2 | −2.4 | −2.6 |
| 0.5 | 0.5 | 0.5 | 0.5 | — | 0.5 | 0.5 | — | 38 | 30 | 24 | +2.2 | −2.0 | −2.1 | −1.1 | −1.5 | −1.3 |
| 5.0 | 3.0 | 3.0 | 3.0 | — | 5.0 | 5.0 | — | 72 | 26 | 21 | +4.3 | −4.6 | −4.4 | −2.4 | −3.0 | −2.7 |
| 0.1 | 0.1 | — | 0.1 | — | 0.01 | — | 0.01 | 15 | 11 | 16 | +9.1 | −9.7 | −9.8 | −9.4 | −8.6 | −8.8 |
| 0.5 | 0.1 | — | 0.5 | — | 0.5 | — | 0.5 | 20 | 11 | 16 | +8.6 | −9.2 | −9.1 | −7.4 | −9.2 | −7.5 |
| 0.5 | 0.5 | — | 0.5 | — | 0.5 | — | 0.5 | 33 | 17 | 19 | +5.2 | −5.8 | −5.5 | −4.0 | −5.7 | −5.2 |
| 0.5 | 3.0 | — | 0.5 | — | 0.5 | — | 0.5 | 50 | 14 | 17 | +8.8 | −9.4 | −9.6 | −6.7 | −8.6 | −7.5 |

Table 2-continued

| Additives (mole %) | | | | | | | | Characteristics of Resultant Resistor | | | Change Rate after Impulse Test (%) | | | Change Rate after D.C. Load Life Test (%) | | |
|---|---|---|---|---|---|---|---|---|---|---|---|---|---|---|---|---|
| $Bi_2O_3$ | CoO | MnO | $TiO_2$ | $NiF_2$ | $AlF_3$ | $CrF_3$ | SrO | C (V) at 10mA | $n_1$ | $n_2$ | ΔC at 1mA | $\Delta n_2$ | $\Delta n_2$ | ΔC at 10mA | $\Delta n_1$ | $\Delta n_2$ |
| 5.0 | 3.0 | — | 3.0 | — | 5.0 | — | 5.0 | 65 | 13 | 16 | +9.4 | −10.0 | −9.7 | −8.5 | −9.7 | −8.0 |
| 0.1 | — | 0.1 | 0.1 | — | 0.01 | — | 0.01 | 16 | 12 | 20 | −9.3 | −9.5 | −9.6 | −9.1 | −9.4 | −9.0 |
| 0.5 | — | 0.1 | 0.5 | — | 0.5 | — | 0.5 | 22 | 12 | 21 | −8.9 | −9.2 | −9.3 | −7.1 | −7.5 | −7.2 |
| 0.5 | — | 0.5 | 0.5 | — | 0.5 | — | 0.5 | 35 | 18 | 24 | −5.2 | −5.4 | −5.1 | −3.7 | −3.6 | −3.4 |
| 0.5 | — | 3.0 | 0.5 | — | 0.5 | — | 0.5 | 50 | 11 | 21 | −8.9 | −9.3 | −9.2 | −8.4 | −8.4 | −8.2 |
| 5.0 | — | 3.0 | 3.0 | — | 5.0 | — | 5.0 | 63 | 12 | 22 | −9.7 | −9.5 | −9.6 | −9.2 | −9.5 | −9.0 |
| 0.1 | 0.1 | 0.1 | 0.1 | — | 0.01 | — | 0.01 | 14 | 20 | 20 | +4.7 | −4.8 | −4.5 | −3.0 | −2.8 | −2.8 |
| 0.5 | 0.1 | 3.0 | 0.5 | — | 0.5 | — | 0.5 | 42 | 22 | 22 | +3.9 | −4.1 | −4.1 | −2.9 | −2.6 | −2.9 |
| 0.5 | 3.0 | 0.1 | 0.5 | — | 0.5 | — | 0.5 | 40 | 23 | 22 | +3.3 | −3.3 | −3.9 | −2.5 | −2.5 | −2.5 |
| 0.5 | 3.0 | 3.0 | 0.5 | — | 0.5 | — | 0.5 | 45 | 25 | 21 | +3.8 | −3.9 | −3.6 | −2.0 | −2.2 | −2.9 |
| 0.5 | 0.5 | 0.5 | 0.5 | — | 0.5 | — | 0.5 | 35 | 30 | 24 | +2.1 | −2.3 | −2.5 | −0.7 | −0.5 | −1.1 |
| 5.0 | 3.0 | 3.0 | 3.0 | — | 5.0 | — | 5.0 | 65 | 25 | 20 | +4.6 | −4.2 | −4.0 | −2.9 | −2.1 | −2.3 |
| 0.1 | — | 0.1 | 0.1 | — | — | 0.01 | 0.01 | 17 | 11 | 20 | +8.3 | −8.5 | −9.5 | −9.3 | −8.2 | −9.0 |
| 0.5 | — | 0.1 | 0.5 | — | — | 0.5 | 0.5 | 25 | 11 | 22 | +8.8 | +8.8 | −9.8 | −7.3 | −8.7 | −7.8 |
| 0.5 | — | 0.5 | 0.5 | — | — | 0.5 | 0.5 | 33 | 15 | 24 | +5.1 | −5.0 | −5.6 | −3.9 | −5.3 | −5.5 |
| 0.5 | — | 3.0 | 0.5 | — | — | 0.5 | 0.5 | 42 | 12 | 22 | +9.6 | −6.9 | −8.5 | −6.6 | −8.3 | −7.9 |
| 5.0 | — | 3.0 | 3.0 | — | — | 5.0 | 5.0 | 70 | 13 | 21 | +8.9 | −7.9 | −8.1 | −8.5 | −9.0 | −9.5 |
| 0.1 | 0.1 | — | 0.1 | — | — | 0.01 | 0.01 | 20 | 26 | 16 | +9.2 | −9.1 | −9.2 | −9.1 | −9.3 | −9.2 |
| 0.5 | 0.1 | — | 0.5 | — | — | 0.5 | 0.5 | 22 | 27 | 16 | +8.6 | −8.8 | −8.7 | −7.2 | −7.7 | −7.5 |
| 0.5 | 0.5 | — | 0.5 | — | — | 0.5 | 0.5 | 25 | 29 | 19 | +5.1 | −5.6 | −5.4 | −3.7 | −3.8 | −3.7 |
| 0.5 | 3.0 | — | 0.5 | — | — | 0.5 | 0.5 | 38 | 25 | 17 | +9.2 | −9.1 | −9.2 | −8.4 | −8.4 | −8.5 |
| 5.0 | 3.0 | — | 3.0 | — | — | 5.0 | 5.0 | 60 | 26 | 16 | +9.1 | −9.4 | −9.3 | −9.0 | −9.6 | −9.6 |
| 0.1 | 0.1 | 0.1 | 0.1 | — | — | 0.01 | 0.01 | 14 | 26 | 20 | +4.6 | −4.5 | −4.4 | −2.5 | −2.7 | −2.5 |
| 0.5 | 0.1 | 3.0 | 0.5 | — | — | 0.5 | 0.5 | 20 | 27 | 22 | +33 | −3.7 | −3.9 | −2.8 | −2.9 | −2.7 |
| 0.5 | 0.5 | 0.1 | 0.5 | — | — | 0.5 | 0.5 | 18 | 27 | 22 | +4.3 | −4.1 | −4.6 | −2.4 | −2.6 | −2.4 |
| 0.5 | 3.0 | 3.0 | 0.5 | — | — | 0.5 | 0.5 | 60 | 26 | 20 | +3.7 | −3.1 | −3.0 | −2.6 | −2.5 | −2.3 |
| 0.5 | 0.5 | 0.5 | 0.5 | — | — | 0.5 | 0.5 | 33 | 29 | 24 | +2.5 | −2.2 | −2.0 | −0.5 | −1.0 | −1.2 |
| 5.0 | 3.0 | 3.0 | 3.0 | — | — | 5.0 | 5.0 | 65 | 27 | 21 | +4.1 | −4.1 | −4.5 | −2.0 | −2.2 | −2.1 |

Table 3

| Additives (mole %) | | | | | | | | | | Characteristics of Resultant Resistor | | | Change Rate after Impulse Test (%) | | | Change Rate after D.C. Load Life Test (%) | | |
|---|---|---|---|---|---|---|---|---|---|---|---|---|---|---|---|---|---|---|
| $Bi_2O_3$ | CoO | MnO | $TiO_2$ | $NiF_2$ | $Cr_2O_3$ | NiO | BaO | $B_2O_3$ | $GeO_2$ | C (V) at 10 mA | $n_1$ | $n_2$ | ΔC at 1 mA | $\Delta n_1$ | $\Delta n_2$ | ΔC at 10 mA | $\Delta n_1$ | $\Delta n_2$ |
| 0.1 | 0.1 | 0.1 | 0.1 | 0.01 | 0.01 | — | — | — | — | 21 | 38 | 30 | +3.0 | +1.0 | +1.8 | −0.6 | +2.5 | +2.2 |
| 0.1 | 0.1 | 0.1 | 0.1 | 0.01 | 0.5 | — | — | — | — | 35 | 39 | 31 | +3.2 | +1.2 | +1.9 | −0.7 | +2.3 | +2.3 |
| 0.1 | 0.1 | 0.1 | 0.1 | 0.01 | 5.0 | — | — | — | — | 42 | 40 | 31 | +3.5 | +1.3 | +2.0 | −0.8 | +2.4 | +2.0 |
| 0.5 | 0.5 | 0.5 | 0.5 | 0.5 | 0.01 | — | — | — | — | 30 | 40 | 34 | +2.0 | +4.3 | +5.0 | −0.6 | +4.1 | +3.1 |
| 0.5 | 0.5 | 0.5 | 0.5 | 0.5 | 0.5 | — | — | — | — | 38 | 42 | 35 | +1.6 | +5.0 | +5.2 | −0.6 | +4.2 | +3.0 |
| 0.5 | 0.5 | 0.5 | 0.5 | 0.5 | 5.0 | — | — | — | — | 78 | 40 | 34 | +1.0 | +4.5 | +4.9 | −0.7 | +4.0 | +3.0 |
| 5.0 | 3.0 | 3.0 | 3.0 | 5.0 | 0.01 | — | — | — | — | 40 | 38 | 30 | +2.8 | +1.5 | +2.2 | −0.9 | +2.3 | +2.3 |
| 5.0 | 3.0 | 3.0 | 3.0 | 5.0 | 0.5 | — | — | — | — | 52 | 39 | 32 | +2.8 | +1.8 | +2.0 | −1.0 | +2.2 | +2.5 |
| 5.0 | 3.0 | 3.0 | 3.0 | 5.0 | 5.0 | — | — | — | — | 70 | 39 | 32 | +2.7 | +1.9 | +1.5 | −0.9 | +3.2 | +2.2 |
| 0.1 | 0.1 | 0.1 | 0.1 | 0.01 | — | 0.01 | — | — | — | 10 | 35 | 27 | +4.5 | +0.5 | +0.2 | −1.5 | +0.5 | +0.8 |
| 0.1 | 0.1 | 0.1 | 0.1 | 0.01 | — | 0.5 | — | — | — | 22 | 36 | 27 | +4.0 | +1.2 | +0.5 | −1.4 | +0.8 | +1.0 |
| 0.1 | 0.1 | 0.1 | 0.1 | 0.01 | — | 5.0 | — | — | — | 49 | 36 | 26 | +4.8 | +0.8 | +0.4 | −1.7 | +0.8 | +1.1 |
| 0.5 | 0.5 | 0.5 | 0.5 | 0.5 | — | 0.01 | — | — | — | 17 | 36 | 30 | +4.0 | +2.3 | +1.2 | −0.6 | +2.1 | +2.6 |
| 0.5 | 0.5 | 0.5 | 0.5 | 0.5 | — | 0.5 | — | — | — | 30 | 38 | 31 | +4.5 | +2.4 | +1.8 | −0.6 | +2.5 | +3.0 |
| 0.5 | 0.5 | 0.5 | 0.5 | 0.5 | — | 5.0 | — | — | — | 68 | 37 | 30 | +3.2 | +2.1 | +1.3 | −0.6 | +2.2 | +2.1 |
| 5.0 | 3.0 | 3.0 | 3.0 | 5.0 | — | 0.01 | — | — | — | 32 | 35 | 25 | +4.0 | +0.8 | +0.2 | −1.5 | +1.0 | +1.0 |
| 5.0 | 3.0 | 3.0 | 3.0 | 5.0 | — | 0.5 | — | — | — | 52 | 37 | 27 | +4.5 | +1.2 | +0.3 | −1.9 | +0.7 | +0.7 |
| 5.0 | 3.0 | 3.0 | 3.0 | 5.0 | — | 5.0 | — | — | — | 75 | 37 | 27 | +4.9 | +1.3 | +0.4 | −1.6 | +0.6 | +0.5 |
| 0.1 | 0.1 | 0.1 | 0.1 | 0.01 | — | — | 0.01 | — | — | 13 | 35 | 25 | +4.3 | +0.7 | +0.3 | −1.4 | +0.4 | +0.7 |
| 0.1 | 0.1 | 0.1 | 0.1 | 0.01 | — | — | 0.5 | — | — | 28 | 35 | 25 | +4.5 | +1.3 | +0.5 | −1.6 | +0.6 | +0.9 |
| 0.1 | 0.1 | 0.1 | 0.1 | 0.01 | — | — | 5.0 | — | — | 70 | 36 | 26 | +4.8 | +0.9 | +0.5 | −1.5 | +0.7 | +1.0 |
| 0.5 | 0.5 | 0.5 | 0.5 | 0.5 | — | — | 0.01 | — | — | 16 | 36 | 28 | +4.0 | +2.2 | +1.3 | −0.6 | +2.0 | +2.5 |
| 0.5 | 0.5 | 0.5 | 0.5 | 0.5 | — | — | 0.5 | — | — | 30 | 38 | 30 | +4.5 | +2.0 | +1.5 | −0.6 | +2.3 | +2.9 |
| 0.5 | 0.5 | 0.5 | 0.5 | 0.5 | — | — | 5.0 | — | — | 68 | 37 | 29 | +3.2 | +2.1 | +1.1 | −0.6 | +2.1 | +2.0 |
| 5.0 | 3.0 | 3.0 | 3.0 | 5.0 | — | — | 0.01 | — | — | 33 | 37 | 26 | +4.5 | +1.1 | +0.7 | −1.3 | +0.9 | +0.9 |
| 5.0 | 3.0 | 3.0 | 3.0 | 5.0 | — | — | 0.5 | — | — | 48 | 37 | 26 | +5.2 | +1.2 | +0.6 | −1.5 | +0.7 | +0.7 |
| 5.0 | 3.0 | 3.0 | 3.0 | 5.0 | — | — | 5.0 | — | — | 76 | 36 | 25 | +4.7 | +1.0 | +0.4 | −1.4 | +0.5 | +0.3 |
| 0.1 | 0.1 | 0.1 | 0.1 | 0.01 | — | — | — | 0.01 | — | 18 | 35 | 27 | +5.3 | +0.8 | +0.2 | −1.3 | +0.6 | +0.9 |
| 0.1 | 0.1 | 0.1 | 0.1 | 0.01 | — | — | — | 0.5 | — | 29 | 36 | 27 | +5.5 | +0.9 | +0.5 | −1.6 | +0.8 | +1.1 |
| 0.1 | 0.1 | 0.1 | 0.1 | 0.01 | — | — | — | 5.0 | — | 39 | 36 | 26 | +5.8 | +1.1 | +0.4 | −1.8 | +0.9 | +1.2 |
| 0.5 | 0.5 | 0.5 | 0.5 | 0.5 | — | — | — | 0.01 | — | 25 | 37 | 30 | +3.8 | +2.3 | +1.3 | −0.6 | +2.3 | +2.7 |
| 0.5 | 0.5 | 0.5 | 0.5 | 0.5 | — | — | — | 0.5 | — | 32 | 38 | 31 | +4.3 | +2.4 | +1.5 | −0.5 | +2.7 | +3.1 |
| 0.5 | 0.5 | 0.5 | 0.5 | 0.5 | — | — | — | 5.0 | — | 72 | 37 | 30 | +5.0 | +2.6 | +1.2 | −0.6 | +2.4 | +2.3 |
| 5.0 | 3.0 | 3.0 | 3.0 | 5.0 | — | — | — | 0.01 | — | 35 | 37 | 25 | +5.4 | +1.2 | +0.7 | −1.9 | +1.1 | +1.0 |
| 5.0 | 3.0 | 3.0 | 3.0 | 5.0 | — | — | — | 0.5 | — | 52 | 37 | 26 | +5.7 | +1.5 | +0.5 | −1.7 | +0.8 | +0.8 |
| 5.0 | 3.0 | 3.0 | 3.0 | 5.0 | — | — | — | 5.0 | — | 78 | 36 | 26 | +5.5 | +1.6 | +0.4 | −1.5 | +0.6 | +0.5 |
| 0.1 | 0.1 | 0.1 | 0.1 | 0.01 | — | — | — | — | 0.01 | 16 | 36 | 25 | +3.8 | +1.2 | +1.5 | −0.8 | +0.2 | +0.5 |
| 0.1 | 0.1 | 0.1 | 0.1 | 0.01 | — | — | — | — | 0.5 | 35 | 37 | 26 | +3.7 | +1.3 | +1.0 | −1.2 | +0.5 | +0.3 |
| 0.1 | 0.1 | 0.1 | 0.1 | 0.01 | — | — | — | — | 5.0 | 59 | 37 | 25 | +4.0 | +1.2 | +1.8 | −1.5 | +0.4 | +0.4 |
| 0.5 | 0.5 | 0.5 | 0.5 | 0.5 | — | — | — | — | 0.01 | 29 | 40 | 31 | +2.1 | +4.1 | +4.3 | −0.6 | +0.1 | +1.2 |
| 0.5 | 0.5 | 0.5 | 0.5 | 0.5 | — | — | — | — | 0.5 | 32 | 43 | 32 | +1.5 | +4.5 | +4.5 | −0.5 | +0.2 | +1.3 |
| 0.5 | 0.5 | 0.5 | 0.5 | 0.5 | — | — | — | — | 5.0 | 72 | 39 | 31 | +1.9 | +4.0 | +4.0 | −0.6 | +0.1 | +1.1 |
| 5.0 | 3.0 | 3.0 | 3.0 | 5.0 | — | — | — | — | 0.01 | 37 | 37 | 27 | +3.9 | +1.4 | +2.0 | −0.9 | +0.5 | +0.6 |
| 5.0 | 3.0 | 3.0 | 3.0 | 5.0 | — | — | — | — | 0.5 | 48 | 38 | 27 | +2.9 | +1.5 | +1.8 | −1.2 | +0.6 | +0.5 |
| 5.0 | 3.0 | 3.0 | 3.0 | 5.0 | — | — | — | — | 5.0 | 74 | 37 | 27 | +4.2 | +1.7 | +1.7 | −1.1 | +0.9 | +0.7 |

Table 4

| Sample No. | Heating Cycle Test (%) | | | Humidity Test (%) | | |
|---|---|---|---|---|---|---|
| | $\Delta C$ | $\Delta n_1$ | $\Delta n_2$ | $\Delta C$ | $\Delta n_1$ | $\Delta n_2$ |
| Example 1 | −3.5 to −5.5 | −3.2 to −6.2 | −3.0 to −6.5 | −3.3 to −5.8 | −3.4 to −6.2 | −2.9 to −6.4 |
| Example 2 | −2.0 to −2.9 | −2.1 to −2.8 | −2.0 to −2.5 | -2.4 to −2.9 | −2.2 to −2.6 | −2.1 to −2.7 |
| Example 3 | −0.2 to −0.0 | −0.1 to −0.8 | −0.2 to −0.8 | −0.5 to −1.7 | −0.4 to −1.9 | −0.2 to −1.8 |

What is claimed is:

1. A voltage-dependent resistor of bulk-type comprising a sintered body consisting essentially of, as a main constituent, zinc oxide (ZnO) and, as additives, 0.1 to 5.0 mole percent of bismuth oxide ($Bi_2O_3$), 0.1 to 3.0 mole percent of titanium oxide ($TiO_2$) and 0.01 to 5.0 mole percent of strontium oxide (SrO), and electrodes applied to opposite surfaces of said sintered body.

2. A voltage-dependent resistor as defined by claim 1, wherein said additives further include at least one member selected from the group consisting of 0.1 to 3.0 mole percent of cobalt oxide (CoO) and 0.1 to 3.0 mole percent of manganese oxide (MnO).

* * * * *